United States Patent [19]

Saito et al.

[11] 4,263,391

[45] Apr. 21, 1981

[54] LIQUID DEVELOPMENT PROCESS WITH POROUS ELASTIC DEVELOPMENT CLEANING ROLLER

[75] Inventors: Takashi Saito, Ichikawa; Tsuyoshi Watanabe, Kawasaki, both of Japan

[73] Assignee: Canon Kabushiki Kaisha, Tokyo, Japan

[21] Appl. No.: 68,420

[22] Filed: Aug. 21, 1979

[51] Int. Cl.[3] ..... G03G 15/10; G03G 15/16

[52] U.S. Cl. ..... 430/125; 118/652; 430/126

[58] Field of Search ..... 430/117, 119, 125; 118/652, 659, 661, 660, DIG. 15; 428/309, 313, 323, 402

[56] References Cited

U.S. PATENT DOCUMENTS 4,181,094 1/1980 Gardiner ..... 118/652

FOREIGN PATENT DOCUMENTS 949710 9/1958 Fed. Rep. of Germany ..... 118/661

OTHER PUBLICATIONS

Xerox Disclosure Journal, vol. 1, No. 1, Jan. 1976.

*Primary Examiner*—John D. Welsh

*Attorney, Agent, or Firm*—Fitzpatrick, Cella, Harper & Scinto

[57] ABSTRACT

An electrophotographic process involving the repeated cycles of a developing step for developing an electrostatic latent image formed on a latent image carrying member with a liquid developer, a transfer step for transferring the thus obtained visible image from said latent image carrying member onto another member, and a cleaning step for subsequently cleaning the surface of said latent image carrying member, comprising the use of an elastic rotary member composed of an electroconductive rigid core member, an electroconductive porous elastic member capable of retaining a liquid therein and provided around said core member, and a liquid-permeable insulating flexible member of a thickness in the range of 20 to 400 microns provided to surround the outer periphery of said elastic member, said elastic rotary member being maintained in pressure contact with said latent image carrying member, whereby said developing step is achieved by the liquid developer squeezed out from said elastic rotary member and the excessive liquid developer present on said latent image carrying member is recovered therefrom by absorption upon recovery of said elastic rotary member from the compressed state thereof.

9 Claims, 6 Drawing Figures

LIQUID DEVELOPMENT PROCESS WITH POROUS ELASTIC DEVELOPMENT CLEANING ROLLER

BACKGROUND OF THE INVENTION

1. Field of the Invention

The present invention relates to an electrophotographic process for image formation by repeated steps of the formation of an electrostatic latent image on an electrostatic latent image carrying member, for example a photosensitive member, the wet development of said latent image, the transfer of the thus developed image and the cleaning of said photosensitive member, and more particularly to an electrophotographic process wherein said wet development is achieved by means of an elastic roller.

2. Description of the Prior Art

As an image forming process, there is already known an electrophotographic process in which an electric or electrostatic latent image (hereinafter simply referred to as latent image) is formed on a so-called photosensitive member utilizing a photoconductive substance, is then developed or rendered visible by means of a liquid developer, and the thus developed image is transferred onto a transfer material such as a paper sheet and fixed thereon for example by heating while the photosensitive member is subjected to cleaning for eliminating the remaining liquid developer whereby said photosensitive member is repeatedly utilized in the above-mentioned process.

The development of such latent image can be achieved by a so-called dry development utilizing a toner material consisting of a dry powdered material eventually mixed with solid carrier particles or by a so-called wet development utilizing a liquid developer consisting of toner particles dispersed in a liquid carrier material, the latter being generally employed in the so-called simplified type of electrophotographic copying machine with a relatively slow process speed.

However, it is recently required to achieve a high speed even in such electrophotographic process utilizing wet development. It is at the same time required to provide an elevated image density and a satisfactory image quality without background fog within a limited developing time.

In such electrophotographic process as explained above, the achievement of high-speed process principally depends on the time required for the development step. Stated differently, the acceleration of the entire electrophotographic process can be easily achieved if the development step can be completed within a limited time. However such high-speed process has not been easy to achieve with the conventional wet development methods such as by dipping a latent image carrying surface into a liquid developer or by directing a jet stream of liquid developer onto said latent image carrying surface. More specifically, the conventional wet development methods scarcely reveal practical defects in the developed image at a relatively low process speed generally in the range of 50 to 100 mm/sec., but are almost unable, at a considerably high process speed generally in the range of 200 to 300 mm/sec., to achieve practically acceptable development due to a lowered image density and background fog resulting from the reduced time allowed for the developing step.

In consideration of the above-mentioned drawbacks, there is already proposed, in the Japanese Patent Laid- Open Sho52-40336, a wet development suitable for the high-speed electrophotographic process, in which a liquid-retentive elastic member provided with a liquid-permeating electroconductive flexible surface is utilized as liquid developer supply means and the development of the latent image on the latent image carrying member is conducted in a pressure contact area thereof with said supply means.

Such development method is advantageous in achieving a high-speed electrophotographic process, in comparison with conventionally known wet development utilizing a developer tank or a developer jet, in that the squeeze-supply of the liquid developer and the squeeze-suction of the excessive developer can be achieved simultaneously by elastic deformation of the elastic member maintained under pressure contact. In this method the above-mentioned elastic member is constructed as a rotary member in the form of a roller or an endless belt (hereinafter simply referred to as elastic roller for the purpose of simplicity) which is maintained in rotary motion in contact with the latent image carrying member. The use of such elastic roller in wet development is certainly advantageous in achieving a high-speed electrophotographic process in that, in addition to squeezing out and absorbing of the liquid developer performed substantially simultaneously as explained in the foregoing, a strong electric field is generated between the roller and the latent image due to the electroconductive roller surface and causes rapid displacement of toner particles, thus enabling sufficient development of the latent image for a limited time. It is however not easy to accomplish a high-speed electrophotographic process simply by the use of such elastic roller, and almost impossible when it is combined with the conventionally known technologies.

In the first place a developing roller provided with an electroconductive surface results in an insufficient halftone reproduction because of the excessively strong electric field applied to the latent image as explained in the foregoing, and may often result in white spots in the solid black image area or in undesirable image reversal due to discharge of the electrostatic charge of the latent image to the conductive surface of the roller.

The Japanese Utility Model Publication Sho 53-33560 discloses a roller composed of an electroconductive core member and an electroconductive porous elastic member provided therearound, which however is unable to prevent the above-mentioned drawbacks because of the direct contact of the conductive member with the latent image, and is apt to result in unsatisfactory development or image blur since the surface of the elastic member, when it is brought into pressure contact with the latent image carrying surface, is tightly pressurized thereagainst to hinder the liquid permeation or is displaced in said contact surface.

In consideration of the foregoing, it is essential, in a roller development allowing the realization of a high-speed electrophotographic process, that the electroconductive porous elastic member is not exposed on the surface of the developing roller and that the developing roller is electrically insulating at least at the surface thereof coming into contact with the latent image carrying surface. However the roller with such modification are still insufficient for the practical purpose and tends to result in various drawbacks such as white spots in the solid black image area, undesirable image reversal or extremely deteriorated halftone reproduction for example from a photograph when the developing roller is rendered more electroconductive, or enhanced edge effect, lack of toner in the solid black image area, loss in the image density, elevated background fog or eventually insufficient image transfer when the developing roller is rendered more insulating.

SUMMARY OF THE INVENTION

The principal object of the present invention, therefore, is to provide an improved electrophotographic process for image formation capable of achieving a high-speed process utilizing an elastic roller in the wet development step, and more specifically to provide an electrophotographic process allowing high-speed image reproduction with improved image density, improved halftone reproduction and free from background fog through the full and stable utilization of the developing roller functions.

Another object of the present invention is to provide an electrophotographic process capable of providing an image of practically satisfactory quality even at a high process speed in the range of 150 to 300 mm/sec.

In accordance with the present invention, there is provided an electrophotographic process involving the repeated cycles of a developing step for developing an electrostatic latent image formed on a latent image carrying member with a liquid developer, a transfer step for transferring the thus obtained visible image from said latent image carrying member onto another member, and a cleaning step for subsequently cleaning the surface of said latent image carrying member, comprising the use of an elastic rotary member composed of an electroconductive rigid core member, an electroconductive porous elastic member capable of retaining a liquid therein and provided around said core member, and a liquid-permeable insulating flexible member of a thickness in the range of 20 to 400 microns provided to surround the outer periphery of said elastic member, said elastic rotary member being maintained in pressure contact with said latent image carrying member, whereby said developing step is achieved by the liquid developer squeezed out from said elastic rotary member and the excessive liquid developer present on said latent image carrying member is recovered therefrom by absorption upon recovery of said elastic rotary member from the compressed state thereof.

DESCRIPTION OF THE PREFERRED EMBODIMENTS

For the purpose of facilitating the understanding of the present invention, the structure of the elastic developing roller to be employed in the present invention will be explained in the following by the examples shown in FIGS. 1 and 2.

Figure 1:
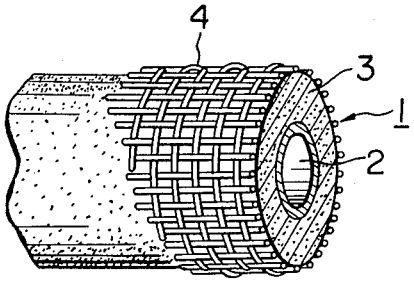
FIGS. 1 and 2 are schematic perspective views showing the structures of the elastic roller to the applicable in the present invention.
Figure 2:
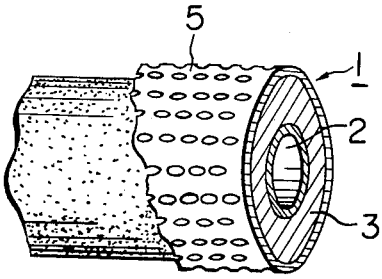

Referring to FIG. 1, the elastic roller 1 comprises a core member 2 composed of an electroconductive rigid material such as a metal, an electroconductive porous elastic member 3 of liquid retentivity composed for example of electroconductive rubber sponge and provided in a substantially uniform thickness around said core member 2, and an insulating net member 4 covering the outer periphery of said elastic member 3. Said elastic member 3 is fixed on said core member 2 by means for example of an adhesive, while said net member 4 is maintained around said elastic member 3 by the elastic recovering force of the member 3 maintained in a somewhat compressed state, whereby said elastic member 3 and the net member 4 are integrally rotated with said core member 2. Said elastic member 3 is provided with elastically deformable continuous pores and is therefore capable of absorbing a liquid thereinto or squeezing it therefrom in accordance with the elastic deformation thereof. The outer net member 4 is an insulating flexible net woven or knitted from natural or synthetic fibers or filaments and allows the liquid permeation into or from said elastic member 3 through the meshes. Thus the liquid previously impregnated in said elastic member 3 is squeezed out through the meshes of said net member 4 when said elastic roller is compressed, and the liquid located outside is absorbed into said elastic member 3 upon elastic recovery thereof when the elastic roller 1 is released from the compression. Said net member 4 is preferably provided with a density in the range of 100 to 300 mesh and is preferably composed of a textile woven from monofilaments of polyamide, polyester, polypropylene, polyether, vinylon etc. in consideration of the liquid permeation, mechanical strength and chemical stability. Furthermore, according to the present invention, the preferred development can be achieved when the thickness of said net member 4 is generally in the range of 20 to 400 microns as will be testified by the following examples. The practically preferred range of the thickness of said net member 4 is in the range of 50 to 300 microns. most preferably 50 to 200 microns. Furthermore said net member 4 may be composed either of a single layer or of plural layers, each of which may be composed of textiles of plain weaving, twill weaving, satin weaving or those further deformed by pressing. It is to be understood that the elastic roller of the present invention may take other various structures. The outermost portion of said elastic roller may be advantageously provided with through holes maintaining the communication between the interior and the exterior of said elastic roller, to have a peripheral surface flexible in a direction perpendicular thereto when brought into contact with another rigid surface, wherein said through holes being so structured as not to be blocked by said rigid surface during said contact. Consequently the aforementioned net member for covering the outer periphery of the elastic roller may be replaced by a plastic film having plural perforations as shown in FIG. 2, wherein a plastic film sleeve 5 is provided with a plurality of circular perforations. Said perforations may naturally be of any other form. The elastic member 3 shown in FIG. 1 or 2 may be composed either of a single layer or of plural layers, and can be composed of any electroconductive material provided with a suitable elasticity and capable of squeezing and absorbing liquid by elastic deformation, such as foam material composed of polystyrene, polyethylene, polyurethane, polyvinyl chloride, styrene-butadiene rubber, nitrile-butadiene rubber etc. mixed with a powdered conductive material such as carbon black or metal, or an elastic material formed from metallic fibers.

Said elastic member 3 is provided with a volume resistivity advantageously in the range of $10^2$ to $10^8$ Ω·cm for the purpose of the present invention, preferably in the range of $10^2$ to $10^6$ Ω·cm particularly for the reproduction of documents or drawings and in the range of $10^5$ to $10^7$ Ω·cm for the reproduction of photographs. The effect of such electric properties of the elastic member 3 will be clarified later by the examples. The core member 2 functions to support said elastic member 3 and at the same time to supply a bias potential therethrough to the elastic roller 1, particularly to the elastic member 3, and is generally composed, as explained in the foregoing, of electroconductive rigid material of metal or alloy such as aluminum or stainless steel.

Figure 3:
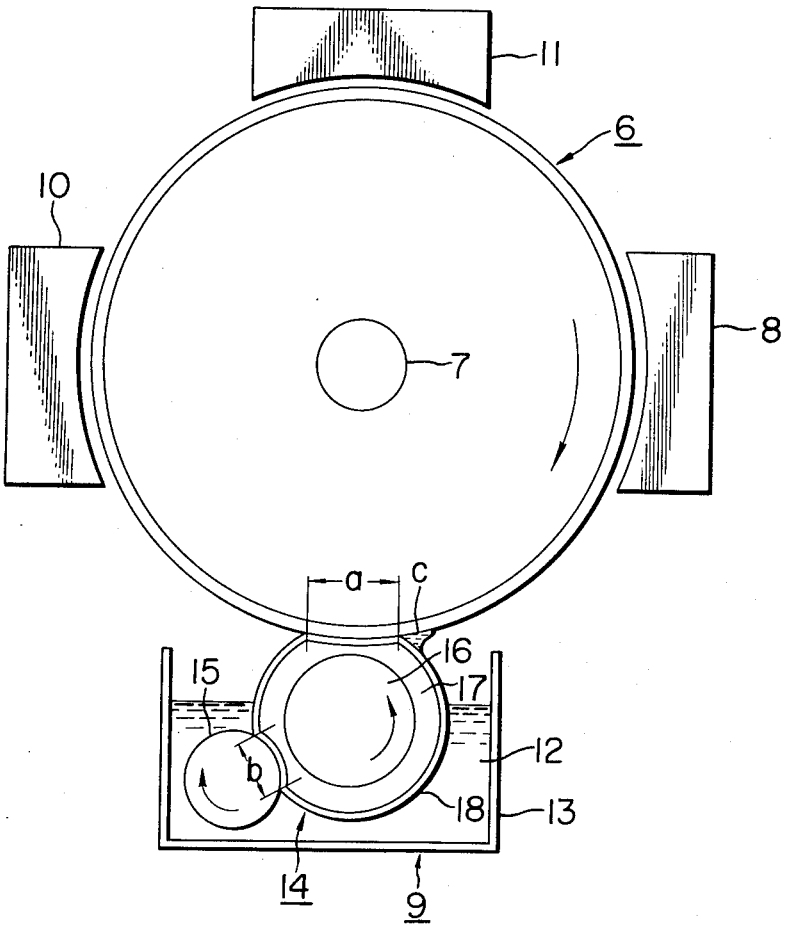
FIG. 3 is a schematic cross-sectional view of an electrophotographic copier embodying the electrophotographic process of the present invention.

In the present invention the electrophotographic process can be conducted in the following manner by the use of the above-explained elastic roller in the developing station. Referring to FIG. 3 showing, in a schematic cross-sectional view, an electrophotographic copier employing the elastic roller of FIG. 1 in the development station thereof, wherein there are shown a drum-shaped photosensitive member utilizing a photoconductive material and maintained in rotary motion in the direction of arrow around the rotary axis 7 thereof, a latent image forming station 8 for forming a latent image on said photosensitive member 6, a developing station 9, a transfer station 10 for transferring the developed image onto a transfer material, and a cleaning station 11 for removing unnecessary developer from the photosensitive member and eliminating unnecessary latent image. Said developing station 9 is located under said photosensitive member 6 and is essentially composed of a liquid tank 13 for containing a liquid developer 12, a developing roller 14 partially immersed in said liquid developer 12 contained in said tank 13, and a refresh roller 15 maintained in pressure contact with said roller 14. As already explained in connection with FIG. 1, the developing roller 14 comprises a core member 16, an electroconductive porous elastic member 17 provided around said core member 16, and an endless insulating net member 18 surrounding said elastic member 17. Upon initiation of the copying operation, the photosensitive drum 6 and the developing roller 14 are rotated, while being maintained in pressure contact, in the directions indicated by the arrow and at substantially the same peripheral speed. The developing roller 14 sufficiently impregnated with the liquid developer 12 is thus brought into contact with the photosensitive member 6, thus forming a nip portion a, whereby the latent image formed on said photosensitive member 6 is developed with the liquid developer squeezed out from said developing roller (portion c) and that present between the photosensitive member 6 and the developing roller 14 (portion a). Subsequently, when the compressed portion of the developing roller 14 leaves the surface of the photosensitive member 6, the excessive liquid developer present in the vicinity thereof is absorbed into the developer roller 14 by the recovery of the elastic member 17 from the compressed state thereof. The developing roller 14 is then brought into pressure contact with the refresh roller 15 (portion b) in the liquid developer 12, thereby replenishing and refreshing the liquid developer contained therein and preparing for the succeeding development step.

The present inventors have verified that the performance of the developing elastic roller to be employed in the above-explained manner is significantly affected by the compositions of the elastic roller, particularly by the electrical properties of the porous elastic member and the thickness of the net member covering said elastic member, i.e. the spacing between the porous elastic member of the elastic roller and the surface of the photosensitive member. More specifically it has been found that the porous elastic member should be provided with a well defined conductivity or a volume resistivity in a particular range suitable for achieving a satisfactory developing electrode effect, in order to realize a satisfactory and stable developing function of the elastic roller even in a high-speed electrophotographic process, and further that the thickness of the net member constituting the outermost portion of the elastic roller is an important factor significantly influencing the result of the development.

Consequently the present inventors have investigated, in the course of the research leading to the present invention, the effect of electrical properties, particularly the volume resistivity, of the elastic member on the various development results such as image density, background fog, halftone reproduction, i.e. gradation, etc. at a high process speed of 200 mm/sec. or more. The result of this investigation indicates that the elastic member exerts a satisfactory developing function when the volume resistivity thereof does not exceed $10^8$ Ω·cm. A volume resistivity higher than this value results in an excessively weak electric field between the latent image and the elastic roller, thereby leading to a reduced displacement speed of toner particles and giving rise to an insufficient image density due to limited toner supply onto the latent image carrying member within the predetermined developing time. Also the background fogging is inevitable in such case since the electric field of the opposite direction present between the image background area of the latent image carrying member and the elastic roller is also too weak to prevent the toner deposition in such background area. Such high volume resistivity is furthermore disadvantageous in that it does not provide a parallel electric field between the latent image and the roller but tends to generate also an electric field in the image background area, eventually leading an enhanced edge effect, a white undeveloped area present in a solid black image area and a deteriorated halftone reproduction.

On the other hand it is rendered possible to obtain a developed image of a satisfactory image density and free from background fog when the volume resistivity of the elastic member is reduced (electroconductivity is increased). However a volume resistivity lower than $10^2$ Ω·cm tends to result in a deteriorated halftone reproduction resulting from excessive toner deposition even in the potential area of the latent image corresponding to the halftone of the original probably due to the excessively strong electric field between the latent image and the roller even when the insulating net member is rendered considerably thick. Besides said excessive toner deposition tends to result generally in unsatisfactory image transfer, particularly in the lack of toner transfer in the solid black image area. Furthermore observed are disadvantages such as white spots in the solid black image area or undesirable image reversal due to the tendency of the charge of the latent image to be discharged to the roller.

On the other hand the investigation of the present inventors have revealed that the net member constituting the outermost portion of the developing roller should be of a thickness not exceeding 400 microns, as a larger thickness in fact leads to a lowered image density and formation of background fog. This is due to the fact that the weakened electric field between the latent image on the photosensitive member and the developing roller reduces the displacing speed of the toner particles, thus reducing the toner supply to the photosensitive member within the predetermined developing time, and that the similarly weakened electric field of the opposite direction between the image background area of the photosensitive member and the developing roller is unable to prevent toner deposition on said background area. Besides an increased thickness of the net member reduces the liquid squeezing ability of the developing roller and tends to cause uneven liquid squeezing. For these reasons, the thickness of the net member should be maintained smaller than 400 microns, particularly for obtaining a sufficiently high image density without background fog.

On the other hand, an excessively small thickness of the net member is again undesirable. Although a smaller thickness is certainly effective in achieving a higher image density and reducing the background fog, the excessively strong electric field between the latent image and the developing roller causes excessive toner deposition even in the potential area of the latent image corresponding to the halftone of the original, thus deteriorating the halftone reproduction. Besides the excessively small thickness of the net member causes the external exposure of the internal electroconductive porous elastic member through the mesh of the net member, eventually resulting in direct contact of said elastic member with the surface of the photosensitive member to discharge the electrostatic charge thereon thereby causing white spots in the solid black image area or an undesirable image reversal. Although a higher volume resistivity of the porous elastic member is advantageous for improving the halftone reproduction, the use of an excessively thin net member will result in the exposure therethrough of said porous elastic member as explained above. As long as the thickness of the net member is so selected as to prevent the external exposure of the elastic member, the volume resistivity thereof is preferably selected at a value not exceeding $10^8$ Ω·cm. In consideration of the foregoing facts and of the respective abrasion and strength of the developing roller and the photosensitive member to be maintained in pressure contact therewith, the minimum thickness of the net member is identified as 20 microns.

The present invention will now be further clarified by the following examples through which the foregoing descriptions will be verified.

EXAMPLE 1

The electroconductive porous elastic material was prepared in the following manner from foamed polyurethane of the following composition to achieve electroconductivity in the foamed state without secondary working. The following composition:

- 100 parts: Desmophen 30360G (Trade name: Farbenfabriken Bayer A.G.)
- 50 parts: water-blended acetylene black
- 30 parts: water-blended ketjen black
- 12 parts: nonionic surfactant was mixed, then added with:

- 40 parts: Desmodur VT50 (Trade name: Farbenfabriken Bayer A.G.)

and blended for 5 seconds at 2,500 rpm. The obtained composition was then foamed, let to stand for 20 minutes at normal temperature, removed from the mold and thereafter dried for 24 hours at 60° C. for eliminating the contained moisture.

In this manner there was obtained polyurethane foam showing a volume resistivity of $3.3\times10^6$ Ω·cm.

The thus obtained polyurethane foam was employed to form a developing roller and utilized in the following experiments for investigating the relationship between the electrode effect thereof and the result of development, i.e. image quality. In these experiments there was utilized a copier comparable to the one shown in FIG. 3, and latent images were formed on the photosensitive member 6 in the latent image forming station 8 with ten originals of different image densities (from low density to high density). In the developing station 9 the developing roller 14 impregnated with the liquid developer 12 was maintained in pressure contact with said photosensitive member 6. Said developing roller 14 was composed of a rigid aluminum core member 16 of an external diameter of 34 mm, a polyurethane foam layer 17 provided therearound and having volume resistivity of $3.3\times10^6$ Ω·cm, and a seamless tubular net 18 of a thickness of 100 microns knitted in 200 mesh from polyester fibers and surrounding said polyurethane foam 17, with a completed diameter of 40 mm. The latent images formed on the photosensitive member 6 were rendered visible by said developing roller, and thus obtained visible images were transferred in the transfer station 10 onto transfer sheets. The foregoing steps were conducted at a process speed of 250 mm/sec. The reflection densities of the originals and the copied images were measured with a Macbeth reflection densitometer (trade name) to obtain the relationship between the two (D-D characteristic) which indicated the satisfactory halftone reproduction as represented by the curve BL in FIG. 4. The maximum reflection density of the copied image was as high as 1.34, and the reflection density in the background area was as low as 0.09, indicating the absence of background fog.

EXAMPLE 2

Figure 4:
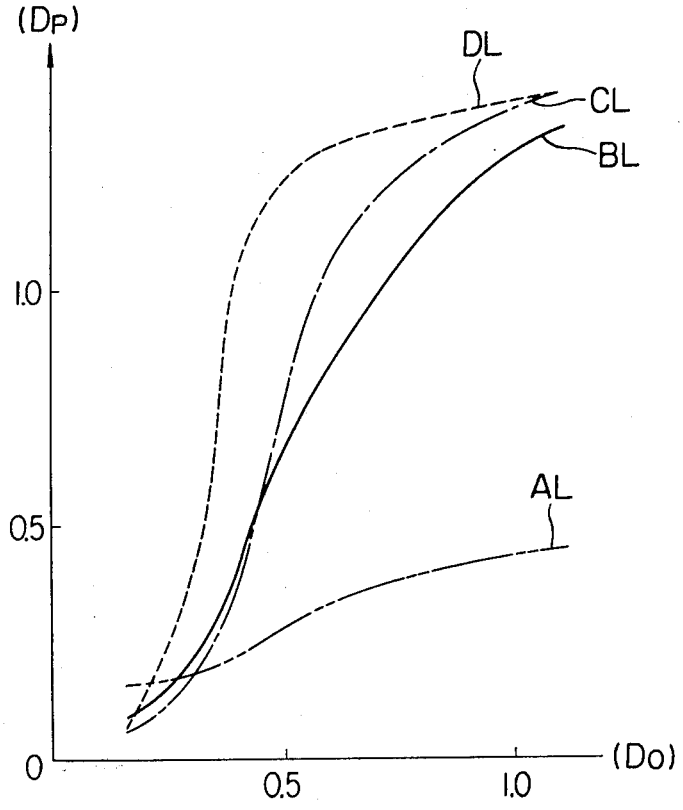
FIGS. 4 to 6 are charts showing the results of the embodiments of the present invention.

Experiments similar to that shown in the Example 1 were conducted with polyurethane foams of different volume resistivities to obtain D-D characteristic curves shown in FIG. 4, representing the original reflection density $D_o$ and the copy reflection density $D_p$ respectively in the abscissa and in the ordinate. The curves AL and CL respectively correspond to the volume resistivities of $10^{11}$ and $10^2$ Ω, while the curve DL represents reference data obtained with a completely conductive material.

The results of these experiments indicate that a volume resistivity higher than $10^8$ Ω·cm leads to the formation of background fog and a low image density while a value lower than $10^2$ Ω·cm is unable to provide satisfactory halftone reproduction. In case of the completely conductive material the copy reflection density reaches a saturation value beyond a certain original reflection density as represented by the curve DL because the toner deposition in excess of the amount is supplied to the copy image corresponding to the original of halftone area, and also because that the toner particles present in excess of a certain limit amount on the transfer sheet do not contribute to increase the reflection density.

EXAMPLE 3

Experiments similar to those in the Example 1 were conducted at a process speed of 220 mm/sec and with a developing roller composed of a rigid aluminum core member of a diameter of 54 mm, a neoprene-butadiene rubber (NBR) foam of a volume resistivity of $1.7\times10^7$ Ω·cm adhered to the periphery of said core member, and a seamless tubular net of 200-mesh woven polyamide fibers with a thickness of 250 microns and a diameter of 60 mm. The obtained image showed satisfactory halftone reproduction (gradation) with the maximum copy reflection density as high as 1.2. Also the reflection density in the background area was as low as 0.08, showing the absence of background fog.

EXAMPLE 4

Following experiments were conducted to investigate the relationship between the thickness of the net member on the developing roller and its developing effect.

In a copier substantially similar to that shown in FIG. 3, two latent images were formed on the photosensitive member 6 in the latent image forming station 8, respectively corresponding to an original of a solid black area for measuring the maximum image reflection density and that of a solid white area for measuring the background fog.

In the developing station 9, the developing roller 14 impregnated with the liquid developer 12 was maintained in pressure contact with said photosensitive member 6. At this time, the roller 14 was composed of a rigid aluminum core member 16 of a diameter of 34 mm, an electroconductive polyurethane foam layer 17 prepared in a similar manner as explained in the Example 1 and adhered on the outer periphery of said core member, and a seamless tubular 200-mesh net 18 woven from polyester fibers and provided to surround said foam layer, with a whole outer diameter of 40 mm. The abovementioned latent images were rendered visible by the abovementioned developing roller, and the obtained images were transferred in the transfer station 10 onto transfer sheets. The foregoing steps were conducted with a process speed of 280 mm/sec. The measurements with the Macbeth reflection densitometer (trade name) showed the maximum copy reflection density of 1.25 and the background reflection density as low as 0.08.

EXAMPLE 5

Figure 5:
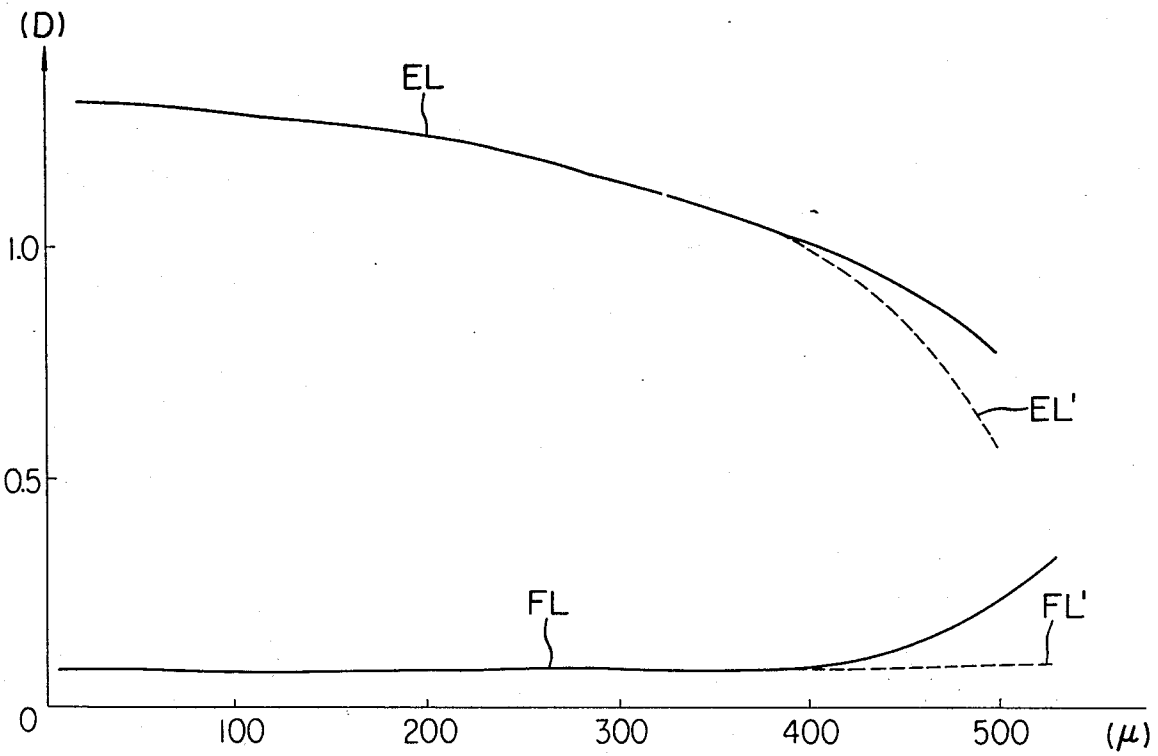

Experiments similar to those in the Example 4 were conducted with the net members of different thicknesses to obtain the results shown in FIG. 5, representing the reflection density D in the ordinate as a function of net thickness in microns in the abscissa, wherein the curves EL and FL respectively represent the maximum copy reflection density and the background reflection density. These results indicate that a net thickness exceeding 400 microns leads to formation of background fog, an insufficiently low image density, and insufficient and uneven liquid squeezing, while a net thickness less than 20 microns does not provide satisfactory halftone reproduction and tends to result in undesirable image reversal. The broken-lined curves EL' and FL' were obtained, in order to prevent the background fog encountered in case of a net thickness exceeding 400 microns, by applying to the developing roller a bias potential equal to the background potential of the latent image plus 100 to 200 V. Although the background fog could be removed in this manner as shown in FIG. 5, satisfactory images could not be obtained due to loss in the reflection density.

EXAMPLE 6

Experiments similar to those in the Example 4 were conducted at a process speed of 200 mm/sec and with a developing roller composed of a rigid core member of a diameter of 54 mm, an electroconductive neoprene-butadiene rubber (NBR) foam adhered to the outer periphery thereof, a first seamless tubular 100-mesh net knitted from polyamide fibers of a thickness of 180 microns and an outer diameter of 60 mm and provided to cover said foam, and a second seamless tubular 200-mesh net knitted from polyester fibers of a thickness of 110 microns and a diameter of 60 mm and provided to cover said first net. The obtained images shows satisfactory halftone reproduction, with the maximum copy reflection density of 1.0 and the background reflection density of 0.07.

EXAMPLE 7

Figure 6:
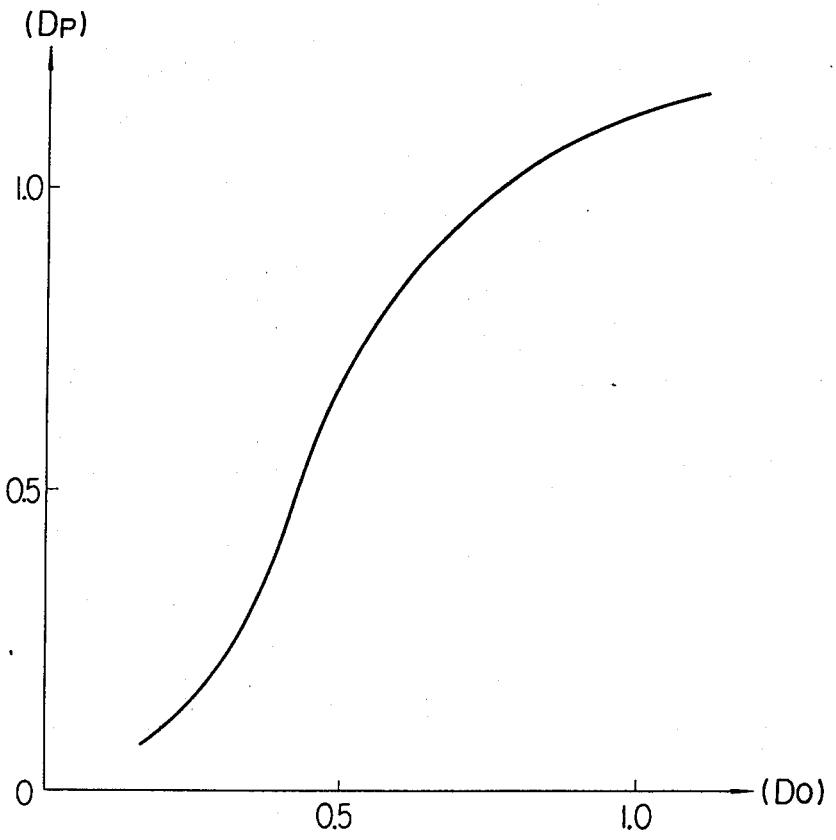

In order to investigate the quality of halftone reproduction in the present invention, experiments were conducted in a similar manner as in the Example 4, utilizing the developing roller shown in the Example 4 and the originals with 10 different densities. The obtained images showed satisfactory halftone reproduction as represented by the D-D characteristics in FIG. 6, showing the copy density $D_p$ in the ordinate as a function of the original density $D_o$ in the abscissa.

As detailedly explained in the foregoing, the improvements in the developing roller according to the present invention allow to achieve the following advantages, particularly at a high process speed:

(1) A high-speed image formation is rendered possible as the developing roller performs an extremely high-speed development:

(2) The development of latent image and strong removal of excessive developer, both achieved within a short time, a suitable for a high-speed copier:

(3) The entire apparatus can be simplified as a separate liquid squeezing means as in the conventional technology is no longer required after the development:

(4) High-quality image formation can be assured for a prolonged period as the precise development of the latent image and the complete removal of the excessive liquid developer can be stably performed.

(5) The constant and complete squeezing of liquid developer provides a high-quality image without blurring and economizes the consumption of liquid developer:

(6) Clear image with satisfactory halftone reproduction and without background fog can be assured over a prolonged period:

(7) The reduced carry-over of the liquid developer reduces the liquid evaporation outside the apparatus and thus avoids the econological concern: and (8) The development of latent image can be achieved efficiently within a smaller space compared with that in the conventional technology.

What we claim is:

1. An electrophotographic process involving the repeated cycles of a developing step for developing an electrostatic latent image formed on a latent image carrying member with a liquid developer, a transfer step for transferring the thus obtained visible image from said latent image carrying member onto another member, and a cleaning step for subsequently cleaning the surface of said latent image carrying member, comprising the use of an elastic rotary member composed of an electroconductive rigid core member, an electroconductive porous elastic member of a volume resistivity in the range of $10^2$ to $10^8$ Ω·cm capable of retaining a liquid therein and provided around said core member, and a liquid-permeable insulating flexible member of a thickness in the range of 20 to 400 microns provided to surround the outer periphery of said elastic member, said elastic rotary member being maintained in pressure contact with said latent image carrying member, whereby said developing step is achieved by the liquid developer squeezed out from said elastic rotary member and the excessive liquid developer present on said latent image carrying member is recovered therefrom by absorption upon recovery of said elastic rotary member from the compressed state thereof.

2. An electrophotographic process according to the claim 1, wherein said porous elastic member is provided with a volume resistivity in the range of $10^2$ to $10^6$ Ω·cm.

3. An electrophotographic process according to the claim 1, wherein said porous elastic member is provided with a volume resistivity in the range of $10^5$ to $10^7$ Ω·cm.

4. An electrophotographic process according to the claim 1, wherein said flexible member is provided with a thickness in the range of 50 to 300 microns.

5. An electrophotographic process according to the claim 1, wherein said flexible member is provided with a thickness in the range of 50 to 200 microns.

6. An electrophotographic process according to the claim 1, wherein said flexible member is a net-like member.

7. An electrophotographic process according to the claim 1, wherein said flexible member is composed of a woven textile of monofilaments of any of polyamide, polyester, polypropylene, polyether and polyvinyl alcohol synthetic fiber.

8. An electrophotographic process according to the claim 1, wherein said process is conducted at a process speed in the range of 150 to 300 mm/sec.

9. An electrophotographic process according to the claim 1, wherein the development of said electrostatic latent image is conducted under a bias potential applied to said elastic rotary member.

* * * * *

UNITED STATES PATENT AND TRADEMARK OFFICE

CERTIFICATE OF CORRECTION

PATENT NO. : 4,263,391

DATED : April 21, 1981

INVENTOR(S) : TAKASHI SAITO, ET AL.

It is certified that error appears in the above—identified patent and that said Letters Patent is hereby corrected as shown below:

Column 3, line 50, delete "to the";

Column 6, line 66, change "have" to --has--;

Column 10, line 41, change "a" (first occurrence) to --is--.

Signed and Sealed this

*Twenty-second* Day of *September 1981*

[SEAL]

*Attest:*

GERALD J. MOSSINGHOFF

*Attesting Officer*

*Commissioner of Patents and Trademarks*